US010386873B2

(12) United States Patent
Zhang et al.

(10) Patent No.: US 10,386,873 B2
(45) Date of Patent: Aug. 20, 2019

(54) POWER SUPPLY VOLTAGE CONTROL CIRCUIT AND METHOD, DRIVER INTEGRATED CIRCUIT, AND DISPLAY DEVICE

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Boya Zhang, Beijing (CN); Zhaohui Meng, Beijing (CN); Chenggeng Zhang, Beijing (CN); Lintao Zhang, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 65 days.

(21) Appl. No.: 15/508,315

(22) PCT Filed: Sep. 7, 2016

(86) PCT No.: PCT/CN2016/098348
§ 371 (c)(1),
(2) Date: Mar. 2, 2017

(87) PCT Pub. No.: WO2017/118070
PCT Pub. Date: Jul. 13, 2017

(65) Prior Publication Data

US 2018/0239379 A1 Aug. 23, 2018

(30) Foreign Application Priority Data

Jan. 4, 2016 (CN) ..... 2016 1 0006334

(51) Int. Cl.
*G09G 3/3225* (2016.01)
*G05F 1/46* (2006.01)
(Continued)

(52) U.S. Cl.
CPC ..... *G05F 1/461* (2013.01); *G05F 1/10* (2013.01); *G09G 3/3208* (2013.01);
(Continued)

(58) Field of Classification Search
CPC ..... G05F 1/461; G09G 3/3225; G09G 2310/0291; G09G 2320/0204; G09G 2330/021
(Continued)

(56) References Cited

U.S. PATENT DOCUMENTS

2002/0041279 A1 4/2002 Chou
2013/0241808 A1* 9/2013 Kwon ..... H02M 3/158 345/76
(Continued)

FOREIGN PATENT DOCUMENTS

CN 1773409 A 5/2006
CN 101873065 A 10/2010
(Continued)

OTHER PUBLICATIONS

Machine translation of WO 2015/0172470 A1.*
(Continued)

*Primary Examiner* — Michael Pervan
(74) *Attorney, Agent, or Firm* — Ladas & Parry LLP

(57) ABSTRACT

Provided are a power supply voltage control circuit and a method thereof, a driver integrated circuit, and a display device. The power supply voltage control circuit comprises: a voltage detection unit (11) configured to detect a power supply voltage (ELVDD, ELVSS) received by the display panel (72) from a power supply circuit (73); a comparison
(Continued)

unit (12) configured to obtain a voltage difference between the power supply voltage (ELVDD, ELVSS) and a reference voltage (VF1,VF2) through comparison; and a power supply voltage control unit (13) configured to transmit a power supply voltage control signal to the power supply circuit (73) according to the voltage difference and the reference voltage (VF1,VF2), so that the power supply circuit (73) outputs a corresponding power supply voltage to the display panel (72), so as to compensate for the voltage drop loss during voltage transmission, optimize display effect of the product, reduce effectively the voltage drop loss from the output terminal of the power supply circuit to the display panel side can be, and ensure consistency of the voltages inputted into the display panel.

19 Claims, 4 Drawing Sheets

(51) Int. Cl.
*G05F 1/10* (2006.01)
*G09G 3/3208* (2016.01)

(52) U.S. Cl.
CPC ... *G09G 3/3225* (2013.01); *G09G 2310/0291* (2013.01); *G09G 2320/0204* (2013.01); *G09G 2320/0223* (2013.01); *G09G 2330/02* (2013.01); *G09G 2330/021* (2013.01)

(58) Field of Classification Search
USPC ..... 345/211–213
See application file for complete search history.

(56) References Cited

U.S. PATENT DOCUMENTS

| | | | | |
|---|---|---|---|---|
| 2015/0130690 | A1* | 5/2015 | Kim | G09G 3/3233 345/78 |
| 2015/0153605 | A1* | 6/2015 | Chang | G02F 1/13306 349/33 |
| 2015/0155779 | A1 | 6/2015 | Kwon et al. | |

FOREIGN PATENT DOCUMENTS

| | | | | |
|---|---|---|---|---|
| CN | 102968970 | A | 3/2013 | |
| CN | 103312164 | A | 9/2013 | |
| CN | 103366706 | A | 10/2013 | |
| CN | 103996374 | A | 8/2014 | |
| CN | 105468063 | A | 4/2016 | |
| CN | 205680029 | U | 11/2016 | |
| WO | WO 2015172470 | A1 * | 11/2015 | G09G 3/32 |

OTHER PUBLICATIONS

International Search Report and Written Opinion dated Dec. 9, 2016; PCT/CN2016/098348.
First Chinese Office Action dated Jul. 25, 2016; Appln. No. 201610006334.9.

* cited by examiner

POWER SUPPLY VOLTAGE CONTROL CIRCUIT AND METHOD, DRIVER INTEGRATED CIRCUIT, AND DISPLAY DEVICE

TECHNICAL FIELD

The present disclosure relates to a power supply voltage control circuit and a method thereof, a driver integrated circuit, and a display device.

BACKGROUND

Control manners of conventional display panels are that a power supply circuit directly outputs a power supply voltage to an OLED (Organic Light-Emitting Diode) display panel. For the OLED display panel, the power supply voltage outputted by the power supply circuit can cause great impact on a Gamma voltage, however, an adjusted Gamma voltage has already been burned in a driver IC (integrated Circuit) before shipment of the OLED display panel, under normal circumstances, the power supply circuit will be placed on a motherboard, the power supply voltage is transmitted through a FPC (Flexible Printed Circuit) to reach the OLED display panel, there will be some voltage drop loss during the transmission. And layout of peripheral circuits of the power supply circuit will also have great impact on the power supply voltage outputted by the power supply circuit, thus it is impossible to guarantee that a value of the power supply voltage inputted into the OLED display panel when burning the Gamma voltage is the same as a value of the power supply voltage outputted to the OLED display panel from the motherboard, as a result, it is likely to affect the display effect of the OLED display panel. In addition, during actual displaying of the OLED display panel, different loads will also affect an actual output of the power supply voltage and cause an IR drop problem, which will also have great impact on the display effect of the OLED display panel.

SUMMARY

The present disclosure provides a power supply voltage control circuit and a method thereof, a driver integrated circuit, and a display device, to solve the problem that there is a voltage drop between a power supply voltage output terminal of the power supply circuit and a power supply voltage receiving terminal of the display panel.

At least one embodiment of the present disclosure provides a power supply voltage control circuit for a display panel, comprising: a voltage detection unit configured to detect a power supply voltage received by the display panel from a power supply circuit; a comparison unit configured to obtain a voltage difference between the power supply voltage and a reference voltage through comparison; and a power supply voltage control unit configured to transmit a power supply voltage control signal to the power supply circuit according to the voltage difference and the reference voltage, so that the power supply circuit outputs a corresponding power supply voltage to the display panel.

In an implementation, the power supply voltage control circuit further comprises: an amplification unit configured to amplify the voltage difference from the comparison unit and transmit an amplified voltage difference to the power supply voltage control unit.

In an implementation, the power supply voltage control signal is a pulse signal based on a single-wire protocol, and a magnitude of the power supply voltage outputted from the power supply circuit to the display panel corresponds to a pulse number of the pulse signal.

In an implementation, the power supply voltage includes a positive power supply voltage and a negative power supply voltage. The reference voltage includes a first reference voltage and a second reference voltage. The voltage detection unit is configured to detect a positive power supply voltage and a negative power supply voltage received by the display panel from the power supply circuit. The comparison unit is configured to obtain a first voltage difference between the positive power supply voltage and the first reference voltage through comparison and obtain a second voltage difference between the negative power supply voltage and the second reference voltage through comparison. The power supply voltage control unit is configured to transmit a first power supply voltage control signal to the power supply circuit according to the first voltage difference and the first reference voltage, so that the power supply circuit outputs a corresponding positive power supply voltage to the display panel, and is further configured to transmit a second power supply voltage control signal to the power supply circuit according to the second voltage difference and the second reference voltage, so that the power supply circuit outputs a corresponding negative power supply voltage to the display panel.

In an implementation, the amplification unit is configured to amplify the first voltage difference and the second voltage difference from the comparison unit, respectively, and transmit an amplified first voltage difference and an amplified second voltage difference to the power supply voltage control unit.

In an implementation, the comparison unit comprises a first comparison module and a second comparison module;

the first comparison module comprises a first operational amplifier, a first resistor, a second resistor, a third resistor, and a fourth resistor;

a non-inverting input terminal of the first operational amplifier is connected to the positive power supply voltage through the fourth resistor, an inverting input terminal of the first operational amplifier is connected to the first reference voltage through the first resistor, and an output terminal of the first operational amplifier is connected to the non-inverting input terminal of the first operational amplifier through the third resistor;

the inverting input terminal of the first operational amplifier is further grounded through the second resistor, and the first operational amplifier outputs the first voltage difference through its output terminal;

the second comparison module comprises a second operational amplifier, a fifth resistor, a sixth resistor, a seventh resistor, and an eighth resistor;

a non-inverting input terminal of the second operational amplifier is connected to the negative power supply voltage through the eighth resistor, an inverting input terminal of the second operational amplifier is connected to the second reference voltage through the fifth resistor, and an output terminal of the second operational amplifier is connected to the non-inverting input terminal of the second operational amplifier through the seventh resistor;

the inverting input terminal of the second operational amplifier is further grounded through the sixth resistor; and the second operational amplifier outputs the second voltage difference through its output terminal.

In an implementation, the amplification unit comprises a first amplification module and a second amplification module;

the first amplification module comprises a third operational amplifier, a ninth resistor, and a tenth resistor;

a non-inverting input terminal of the third operational amplifier is connected to the output terminal of the first operational amplifier, an inverting input terminal of the third operational amplifier is grounded through the tenth resistor, and an output terminal of the third operational amplifier is connected to the inverting input terminal of the third operational amplifier through the ninth resistor; and the third operational amplifier outputs an amplified first voltage difference through its output terminal;

the second amplification module comprises a fourth operational amplifier, an eleventh resistor, and a twelfth resistor;

a non-inverting input terminal of the fourth operational amplifier is connected to the output terminal of the second operational amplifier, an inverting input terminal of the fourth operational amplifier is grounded through the twelfth resistor, and an output terminal of the fourth operational amplifier is connected to the inverting input terminal of the fourth operational amplifier through the eleventh resistor, and the fourth operational amplifier outputs an amplified second voltage difference through its output terminal.

In an implementation, the power supply voltage control unit comprises a first voltage control module and a second voltage control module;

the first voltage control module is configured to generate a first power supply voltage control signal based on the amplified first voltage difference and the first reference voltage and transmit the first power supply voltage control signal to the power supply circuit, so that the power supply circuit outputs a positive power supply voltage according to the first power supply voltage control signal; the first power supply voltage control signal is a pulse signal based on a single-wire protocol; and the second voltage control module is configured to generate a second power supply voltage control signal based on the amplified second voltage difference and the second reference voltage and transmit the second power supply voltage control signal to the power supply circuit, so that the power supply circuit outputs a negative power supply voltage according to the second power supply voltage control signal; the second power supply voltage control signal is a pulse signal based on a single-wire protocol.

In an implementation, the amplified first voltage difference outputted by the third operational amplifier is a digital signal, and the amplified second voltage difference outputted by the fourth operational amplifier is a digital signal; the first voltage control module is further configured to perform digital-to-analog conversion on the amplified first voltage difference, and process the amplified first voltage difference, so as to cause an accuracy of the amplified first voltage difference to be the same as an accuracy of the first reference voltage; the second voltage control module is further configured to perform digital-to-analog conversion on the amplified second voltage difference, and process the amplified second voltage difference, so as to cause an accuracy of the amplified second voltage difference to be the same as an accuracy of the second reference voltage.

In an implementation, the power supply voltage includes a positive power supply voltage or a negative power supply voltage.

The reference voltage includes a first reference voltage.

The comparison unit is configured to obtain a first voltage difference between the power supply voltage and the first reference voltage through comparison.

The power supply voltage control unit is configured to transmit a first power supply voltage control signal to the power supply circuit according to the first voltage difference and the first reference voltage, so that the power supply circuit outputs a corresponding power supply voltage to the display panel.

In an implementation, the amplification unit is configured to amplify the first voltage difference from the comparison unit, and transmit an amplified first voltage difference to the power supply voltage control unit.

In an implementation, the comparison unit comprises a first comparison module; the first comparison module comprises a first operational amplifier, a first resistor, a second resistor, a third resistor, and a fourth resistor;

a non-inverting input terminal of the first operational amplifier is connected to the positive power supply voltage or the negative power supply voltage through the fourth resistor, an inverting input terminal of the first operational amplifier is connected to the first reference voltage through the first resistor, and an output terminal of the first operational amplifier is connected to the non-inverting input terminal of the first operational amplifier through the third resistor;

the inverting input terminal of the first operational amplifier is further grounded through the second resistor, and the first operational amplifier outputs the first voltage difference through its output terminal.

In an implementation, the amplification unit comprises a first amplification module; the first amplification module comprises a second operational amplifier, a fifth resistor, and a sixth resistor.

a non-inverting input terminal of the second operational amplifier is connected to the output terminal of the first operational amplifier, an inverting input terminal of the second operational amplifier is grounded through the sixth resistor, and an output terminal of the second operational amplifier is connected to the inverting input terminal of the second operational amplifier through the fifth resistor, and the second operational amplifier outputs an amplified first voltage difference through its output terminal.

In an implementation, the power supply voltage control unit comprises a first voltage control module; and the first voltage control module is configured to generate a first power supply voltage control signal based on the amplified first voltage difference and the first reference voltage and transmit the first power supply voltage control signal to the power supply circuit, so that the power supply circuit outputs a positive power supply voltage or a negative power supply voltage according to the first power supply voltage control signal; the first power supply voltage control signal is a pulse signal based on a single-wire protocol.

In an implementation, the amplified first voltage difference outputted by the second operational amplifier is a digital signal. The first voltage control module is further configured to perform digital-to-analog conversion on the amplified first voltage difference, and process the amplified first voltage difference, so as to cause an accuracy of the amplified first voltage difference to be the same as an accuracy of the first reference voltage.

The at least one embodiment of the present disclosure further provides a power supply voltage control method applied to the power supply voltage control circuit described above, the power supply voltage control method comprises: a voltage detection step of detecting, by a voltage detection unit, a power supply voltage received by the display panel from a power supply circuit; a comparison step of obtaining, by a comparison unit, a voltage difference between the power supply voltage and a reference voltage through comparison; and a power supply voltage control step of transmitting, by a power supply voltage control unit, a power supply voltage control signal to the power supply circuit according to the voltage difference and the reference voltage, so that the power supply circuit outputs a corresponding power supply voltage to the display panel.

In an implementation, the following is further comprised between the comparison step and the power supply voltage control step: an amplification step of amplifying the voltage difference from the comparison unit and transmitting an amplified voltage difference to the power supply voltage control unit, by an amplification unit.

In an implementation, the power supply voltage control signal is a pulse signal based on a single-wire protocol, and a magnitude of the power supply voltage outputted from the power supply circuit to the display panel corresponds to a pulse number of the pulse signal.

In an implementation, the power supply voltage includes a positive power supply voltage and a negative power supply voltage; the reference voltage includes a first reference voltage and a second reference voltage; the voltage detection step comprises detecting, by the voltage detection unit, a positive power supply voltage and a negative power supply voltage received by the display panel from the power supply circuit; the comparison step comprises obtaining, by the comparison unit, a first voltage difference between the positive power supply voltage and the first reference voltage through comparison and obtaining, by the comparison unit, a second voltage difference between the negative power supply voltage and the second reference voltage through comparison; and the power supply voltage control step comprises transmitting, by the power supply voltage control unit, a first power supply voltage control signal to the power supply circuit according to the first voltage difference and the first reference voltage, so that the power supply circuit outputs a corresponding positive power supply voltage to the display panel, and further transmitting, by the power supply voltage control unit, a second power supply voltage control signal to the power supply circuit according to the second voltage difference and the second reference voltage, so that the power supply circuit outputs a corresponding negative power supply voltage to the display panel.

In an implementation, the power supply voltage includes a positive power supply voltage or a negative power supply voltage; the reference voltage includes a first reference voltage; the comparison step comprises, obtaining, by the comparison unit, a first voltage difference between the power supply voltage and the first reference voltage through comparison; and the power supply voltage control step comprises transmitting, by the power supply voltage control unit, a first power supply voltage control signal to the power supply circuit according to the first voltage difference and the first reference voltage, so that the power supply circuit outputs a corresponding power supply voltage to the display panel.

The at least one embodiment of the present disclosure further provides a driver integrated circuit, comprising the power supply voltage control circuit described above.

The at least one embodiment of the present disclosure further provides a display device, comprising a display panel, a power supply circuit, and the driver integrated circuit described above;

the power supply voltage control circuit comprised in the driver integrated circuit is configured to detect a power supply voltage received by the display panel from a power supply circuit, and transmit a power supply voltage control signal to the power supply circuit according to a voltage difference between the power supply voltage and a reference voltage, so that the power supply circuit outputs a corresponding power supply voltage to the display panel.

In an implementation, the power supply voltage control signal is a pulse signal based on a single-wire protocol. A voltage output of the power supply circuit controlled by instructions of the pulse signal based on the single-wire protocol is stored in the power supply circuit in the form of a look-up table.

The power supply voltage control circuit and the method thereof, the driver integrated circuit, and the display device provided by the at least one embodiment of the present disclosure detect, by the voltage detection unit, a power supply voltage as actually received by the display panel from the power supply circuit, control the power supply voltage outputted by the power supply circuit to the display panel according to a voltage difference between this actually detected power supply voltage and a reference voltage set in advance, to compensate for the voltage drop loss caused during transmission, so that display effect of the product can be optimized, the voltage drop loss from the output terminal of the power supply circuit to the display panel side can be reduced effectively, and consistency of the voltages inputted into the display panel can be ensured.

DETAILED DESCRIPTION OF THE EMBODIMENTS

Hereinafter, the technical solutions in the embodiments of the present disclosure will be described clearly and comprehensively in combination with the drawings in the embodiments of the present disclosure. Obviously, these described embodiments are only parts of the embodiments of the present disclosure, rather than all of the embodiments thereof. All the other embodiments obtained by those of ordinary skill in the art based on the embodiments of the present disclosure without paying creative efforts fall into the protection scope of the present disclosure.

Figure 1:
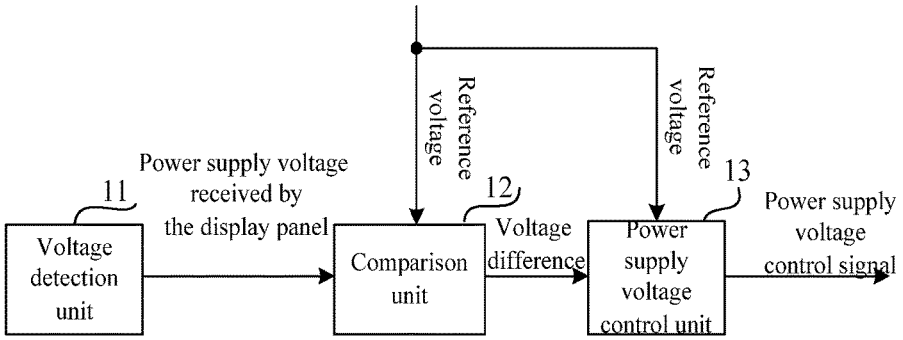
FIG. 1 is a block diagram showing structure of the power supply voltage control circuit for a display panel provided in an embodiment of the present disclosure.

FIG. 1 is a block diagram showing structure of the power supply voltage control circuit for a display panel provided in an embodiment of the present disclosure. As shown in FIG. 1, the power supply voltage control circuit for a display panel provided in an embodiment of the present disclosure comprises: a voltage detection unit 11 configured to detect a power supply voltage received by the display panel from a power supply circuit; a comparison unit 12 connected to the voltage detection unit 11 and configured to obtain a voltage difference between the power supply voltage and a reference voltage through comparison; and a power supply voltage control unit 13 connected to the comparison unit 12 and configured to transmit a power supply voltage control signal to the power supply circuit according to the voltage difference and the reference voltage, so that the power supply circuit outputs a corresponding power supply voltage to the display panel.

The power supply voltage received by the display panel is a driving voltage for driving the display panel, in actual operation, the power supply voltage may include a positive power supply voltage and a negative power supply voltage.

The power supply voltage control circuit for a display panel provided in the embodiment of the present disclosure detects, by the voltage detection unit, a power supply voltage as actually received by the display panel from the power supply circuit, controls the power supply voltage outputted by the power supply circuit to the display panel according to a voltage difference between this actually detected power supply voltage and a reference voltage set in advance, to compensate for the voltage drop loss caused during transmission, so that display effect of the product can be optimized, the voltage drop loss from the output terminal of the power supply circuit to the display panel side can be reduced effectively, and consistency of the voltages inputted to the display panel can be ensured.

Figure 2:
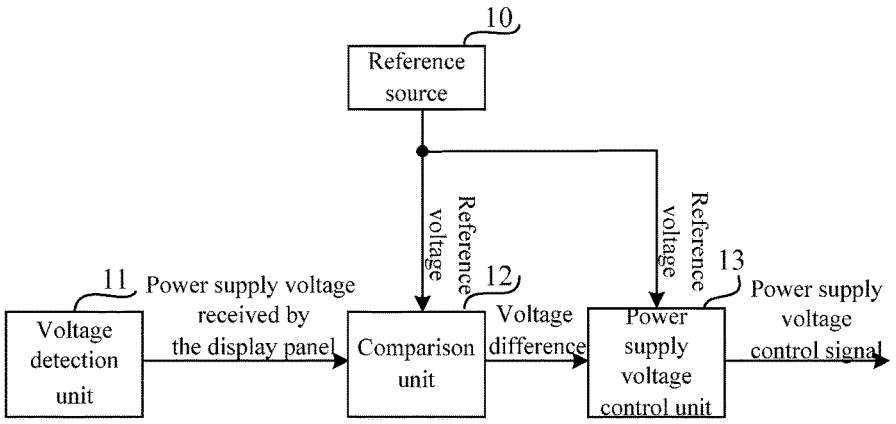
FIG. 2 is a block diagram showing structure of the power supply voltage control circuit for a display panel provided in another embodiment of the present disclosure.

FIG. 2 is a block diagram showing structure of the power supply voltage control circuit for a display panel provided in another embodiment of the present disclosure. In an implementation, as shown in FIG. 2, the reference voltage may be provided by a reference source 10.

The comparison unit 12 and the power supply voltage control unit 13 both are connected to the reference source 10.

Cases of setting the reference voltage in advance may be as follows: for example, an adjusted Gamma voltage has already been burned in the driver integrated Circuit before shipment of the display panel, then a power supply voltage corresponding to this Gamma voltage and provided to the display panel may be set as the reference voltage.

However, other manners may also be adopted as the rules for setting the reference voltage in advance, not limited to the above rules of setting, no more details are repeated here.

Figure 3:
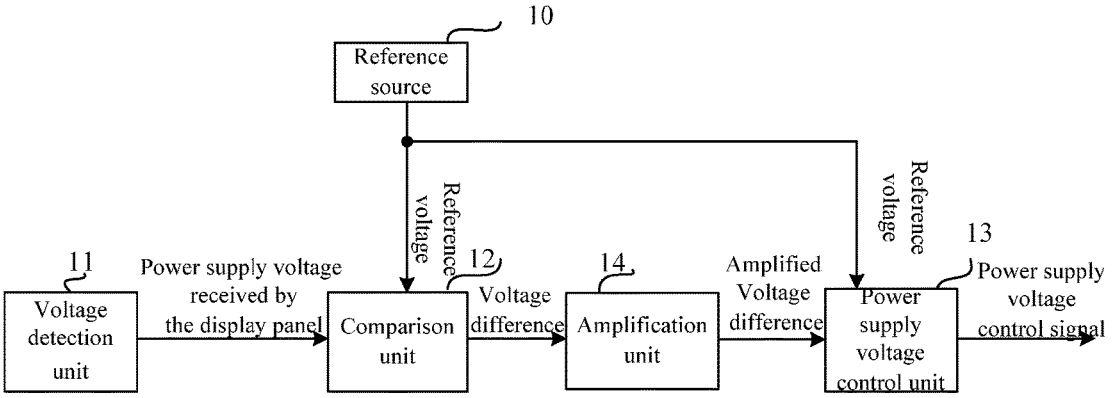
FIG. 3 is a block diagram showing structure of the power supply voltage control circuit for a display panel provided in yet another embodiment of the present disclosure.

FIG. 3 is a block diagram showing structure of the power supply voltage control circuit for a display panel provided in yet another embodiment of the present disclosure. Exemplarily, as shown in FIG. 3, the power supply voltage control circuit in the embodiment of the present disclosure further comprises an amplification unit 14 connected to the comparison unit 12 and the power supply voltage control unit 13, respectively, and configured to amplify the voltage difference from the comparison unit 12 and transmit an amplified voltage difference to the power supply voltage control unit 13.

Compensation for the power supply voltage can be performed more accurately by means of amplifying the voltage difference from the comparison unit 12 by the amplification unit 12.

In an implementation, the power supply voltage control signal may be a pulse signal based on a single-wire protocol, and a magnitude of the power supply voltage outputted from the power supply circuit to the display panel corresponds to a pulse number of the pulse signal.

In an embodiment of the power supply voltage control circuit provided by the present disclosure, the power supply voltage includes a positive power supply voltage and a negative power supply voltage.

The reference voltage includes a first reference voltage and a second reference voltage.

The voltage detection unit is configured to detect a positive power supply voltage and a negative power supply voltage received by the display panel from the power supply circuit.

The comparison unit is configured to obtain a first voltage difference between the positive power supply voltage and the first reference voltage through comparison and obtain a second voltage difference between the negative power supply voltage and the second reference voltage through comparison.

The power supply voltage control unit is configured to transmit a first power supply voltage control signal to the power supply circuit according to the first voltage difference and the first reference voltage, so that the power supply circuit outputs a corresponding positive power supply voltage to the display panel, and is further configured to transmit a second power supply voltage control signal to the power supply circuit according to the second voltage difference and the second reference voltage, so that the power supply circuit outputs a corresponding negative power supply voltage to the display panel.

In the embodiment of the power supply voltage control circuit provided by the present disclosure, as for the case that the power supply voltage provided to the display panel includes a positive power supply voltage and a negative power supply voltage, with the operations of detecting the positive power supply voltage and the negative power supply voltage, comparing, and generating the power supply voltage control signals performed by the voltage detection unit, the comparison unit, and the power supply voltage control unit, respectively, the embodiment of the power supply voltage control circuit provided by the present disclosure can simultaneously compensate for the positive power supply voltage and the negative power supply voltage.

Exemplarily, if the power supply voltage control circuit provided by the embodiment of the present disclosure comprises an amplification unit, the amplification unit is configured to amplify the first voltage difference and the second voltage difference from the comparison unit, respectively, and transmit an amplified first voltage difference and an amplified second voltage difference to the power supply voltage control unit.

Figure 4A:
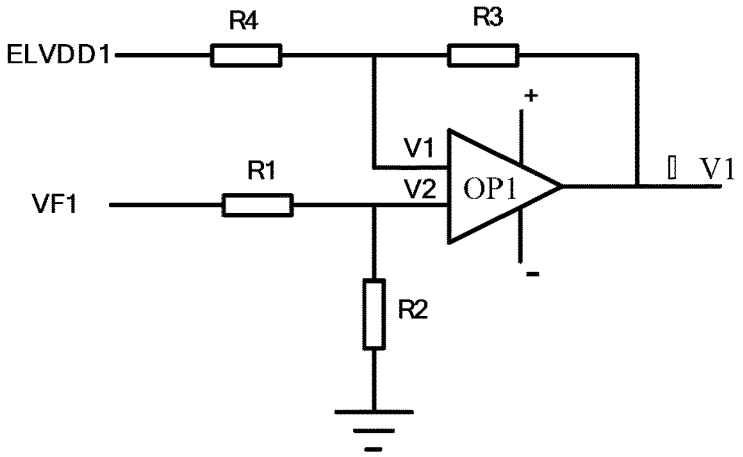
FIG. 4A is a circuit diagram of the first comparison module comprised in the comparison unit in the power supply voltage control circuit for a display panel provided in an embodiment of the present disclosure.
Figure 4B:
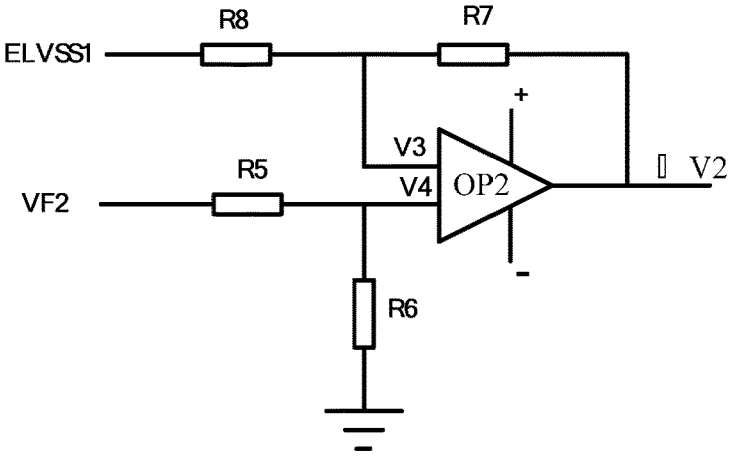
FIG. 4B is a circuit diagram of the second comparison module comprised in the comparison unit in the power supply voltage control circuit for a display panel provided in an embodiment of the present disclosure.

Exemplarily, the comparison unit comprises a first comparison module and a second comparison module. FIG. 4A is a circuit diagram of the first comparison module comprised in the comparison unit in the power supply voltage control circuit for a display panel provided in an embodiment of the present disclosure, and FIG. 4B is a circuit diagram of the second comparison module comprised in the comparison unit in the power supply voltage control circuit for a display panel provided in an embodiment of the present disclosure.

As shown in FIG. 4A, the first comparison module comprises a first operational amplifier OP1, a first resistor R1, a second resistor R2, a third resistor R3, and a fourth resistor R4.

A non-inverting input terminal of the first operational amplifier OP1 is connected, through the fourth resistor R4, to the positive power supply voltage ELVDD1 received by the display panel from the power supply circuit as detected by the voltage detection unit (not shown in FIG. 4A), an inverting input terminal of the first operational amplifier OP1 is connected to the first reference voltage VF1 through the first resistor R1, and an output terminal of the first operational amplifier OP1 is connected to the non-inverting input terminal of the first operational amplifier OP1 through the third resistor R3.

The inverting input terminal of the first operational amplifier OP1 is further grounded through the second resistor R2.

The first operational amplifier OP1 outputs a first voltage difference ΔV1 through its output terminal.

A potential at the non-inverting input terminal of the first operational amplifier OP1 is V1, and a potential at the inverting input terminal of the first operational amplifier OP1 is V2.

The first comparison module as shown in FIG. 4A compares the positive power supply voltage ELVDD1 received by the display panel from the power supply circuit as detected by the voltage detection unit (not shown in FIG. 4A) with the first reference voltage VF1.

According to the principle of a Virtual Short circuit in the operational amplifier: V1=V2; according to the principle of a Virtual Open circuit in the operational amplifier: $I_{R1}=I_{R2}$, $I_{R3}=I_{R4}$, and it can be derived that ΔV1=VF1−ELVDD1.

Here, $I_{R1}$ is the current flowing through R1, $I_{R2}$ is the current flowing through R2, $I_{R3}$ is the current flowing through R3, and $I_{R4}$ is the current flowing through R4.

As shown in FIG. 4B, the second comparison module comprises a second operational amplifier OP2, a fifth resistor R5, a sixth resistor R6, a seventh resistor R7, and an eighth resistor R8.

A non-inverting input terminal of the second operational amplifier OP2 is connected, through the eighth resistor R8, to the negative power supply voltage ELVSS1 received by the display panel from the power supply circuit as detected by the voltage detection unit (not shown in FIG. 4A), an inverting input terminal of the second operational amplifier OP2 is connected to the second reference voltage VF2 through the fifth resistor R5, and an output terminal of the second operational amplifier OP2 is connected to the non-inverting input terminal of the second operational amplifier OP2 through the seventh resistor R7.

The inverting input terminal of the second operational amplifier OP2 is further grounded through the sixth resistor R6.

The second operational amplifier OP2 outputs a second voltage difference ΔV2 through its output terminal.

A potential at the non-inverting input terminal of the second operational amplifier OP2 is V3, and a potential at the inverting input terminal of the second operational amplifier OP2 is V4.

The second comparison module as shown in FIG. 4B compares the negative power supply voltage ELVSS1 received by the display panel from the power supply circuit as detected by the voltage detection unit (not shown in FIG. 4B) with the second reference voltage VF2.

According to the principle of a Virtual Short circuit in the amplifier circuit: V3=V4; according to the principle of a Virtual Open circuit in the amplifier circuit: $I_{R5}=I_{R6}$, $I_{R7}=I_{R8}$, and it can be derived that ΔV2=VF2−ELVSS1.

Here, $I_{R5}$ is the current flowing through R5, $I_{R6}$ is the current flowing through R6, $I_{R7}$ is the current flowing through R7, and $I_{R8}$ is the current flowing through R8.

Figure 5A:
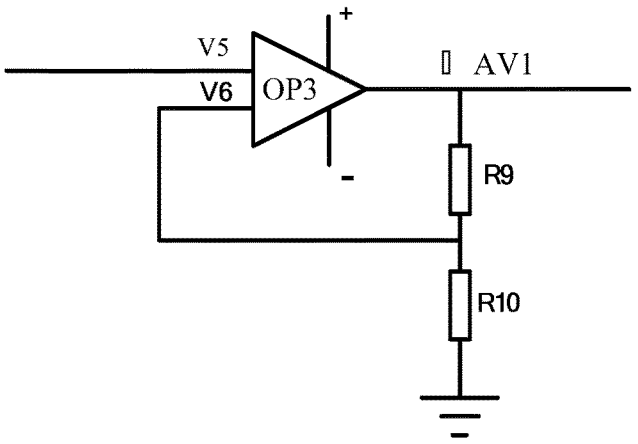
FIG. 5A is a circuit diagram of the first amplification module comprised in the comparison unit in the power supply voltage control circuit for a display panel provided in an embodiment of the present disclosure.
Figure 5B:
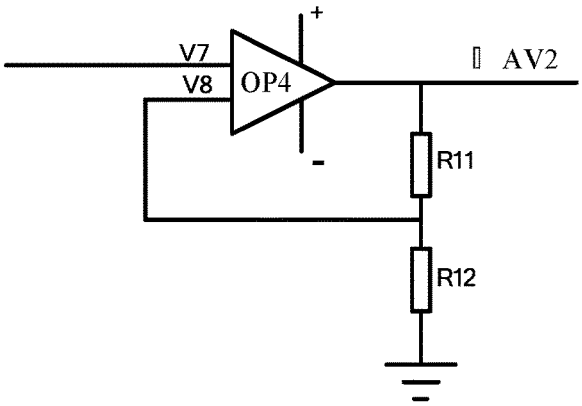
FIG. 5B is a circuit diagram of the second amplification module comprised in the comparison unit in the power supply voltage control circuit for a display panel provided in an embodiment of the present disclosure.

Exemplarily, the amplification unit comprises a first amplification module and a second amplification module. FIG. 5A is a circuit diagram of the first amplification module comprised in the comparison unit in the power supply voltage control circuit for a display panel provided in an embodiment of the present disclosure, and FIG. 5B is a circuit diagram of the second amplification module comprised in the comparison unit in the power supply voltage control circuit for a display panel provided in an embodiment of the present disclosure.

As shown in FIG. 5A, the first amplification module comprises a third operational amplifier OP3, a ninth resistor R9, and a tenth resistor R10.

A non-inverting input terminal of the third operational amplifier OP3 is connected to the output terminal of the first operational amplifier OP1 (OP1 is not shown in FIG. 5A) (that is, a potential V5 at the non-inverting input terminal of OP3 is the first voltage difference ΔV1), an inverting input terminal of the third operational amplifier OP3 is grounded through the tenth resistor R10, and an output terminal of the third operational amplifier OP3 is connected to the inverting input terminal of the third operational amplifier OP3 through the ninth resistor R9.

A potential at the inverting input terminal of the third operational amplifier OP3 is V6.

The third operational amplifier OP3 outputs an amplified first voltage difference ΔAV1 through its output terminal.

According to the principle of a Virtual Short circuit in the operational amplifier: V5=V6; according to the principle of a Virtual Open circuit in the operational amplifier: $I_{R9}=I_{R10}$, and it can be derived that ΔAV1=V5×(R9+R10)/R10.

Here, $I_{R9}$ is the current flowing through R9, and $I_{R10}$ is the current flowing through R10, As shown in FIG. 5B, the second amplification module comprises a fourth operational amplifier OP4, an eleventh resistor R11, and a twelfth resistor R12.

A non-inverting input terminal of the fourth operational amplifier OP4 is connected to the output terminal of the second operational amplifier OP2 (OP2 is not shown in FIG. 5B) (that is, a potential V7 at the non-inverting input terminal of OP4 is the second voltage difference ΔV2), an inverting input terminal of the fourth operational amplifier OP4 is grounded through the twelfth resistor R12, and an output terminal of the fourth operational amplifier OP4 is connected to the inverting input terminal of the fourth operational amplifier OP4 through the eleventh resistor R11.

A potential at the inverting input terminal of the fourth operational amplifier OP4 is V8.

The fourth operational amplifier OP4 outputs an amplified second voltage difference ΔAV2 through its output terminal.

According to the principle of a Virtual Short circuit in the operational amplifier: V7=V8; according to the principle of a Virtual Open circuit in the operational amplifier: $I_{R11}=I_{R12}$, and it can be derived that ΔAV2=V7×(R11+R12)/R12.

Here, $I_{R11}$ is the current flowing through R11, and $I_{R12}$ is the current flowing through R12.

Exemplarily, the power supply voltage control unit comprises a first voltage control module and a second voltage control module.

The first voltage control module is configured to generate a first power supply voltage control signal based on the amplified first voltage difference and the first reference voltage and transmit the first power supply voltage control signal to the power supply circuit, so that the power supply circuit outputs a positive power supply voltage according to the first power supply voltage control signal; the first power supply voltage control signal is a pulse signal based on a single-wire protocol; a magnitude of the positive power supply voltage outputted from the power supply circuit to the display panel corresponds to a pulse number of the first power supply voltage control signal.

The second voltage control module is configured to generate a second power supply voltage control signal based on the amplified second voltage difference and the second reference voltage and transmit the second power supply voltage control signal to the power supply circuit, so that the power supply circuit outputs a negative power supply voltage according to the second power supply voltage control signal; the second power supply voltage control signal is a pulse signal based on a single-wire protocol; a magnitude of the negative power supply voltage outputted from the power supply circuit to the display panel corresponds to a pulse number of the second power supply voltage control signal.

As for the case that the power supply voltage includes a positive power supply voltage and a negative power supply voltage, the power supply voltage control circuit provided by the embodiment of the present disclosure adopts the first voltage control module and the second voltage control module to generate the first power supply voltage control signal and the second power supply voltage control signal, respectively, so as to adjust the positive power supply voltage and the negative power supply voltage outputted by the power supply circuit, respectively.

Exemplarily, the amplified first voltage difference ΔAV1 outputted by the third operational amplifier OP3 shown in FIG. 5A is a digital signal, and the amplified second voltage difference ΔAV2 outputted by the fourth operational amplifier OP4 shown in FIG. 5B is a digital signal.

The first voltage control module needs to first perform digital-to-analog conversion on the amplified first voltage difference ΔAV1, and then process the amplified first voltage difference ΔAV1, so as to cause an accuracy of the amplified first voltage difference ΔAV1 to be the same as an accuracy of the first reference voltage.

The second voltage control module needs to first perform digital-to-analog conversion on the amplified second voltage difference ΔAV2, and then process the amplified second voltage difference ΔAV2, so as to cause an accuracy of the amplified second voltage difference ΔAV2 to be the same as an accuracy of the second reference voltage.

In an implementation, the power supply voltage may also include only one power supply voltage, that is, the power supply voltage includes a positive power supply voltage or a negative power supply voltage. The reference voltage includes a first reference voltage. The comparison unit is configured to obtain a first voltage difference between the power supply voltage and the first reference voltage through comparison. The power supply voltage control unit is configured to transmit a first power supply voltage control signal to the power supply circuit according to the first voltage difference and the first reference voltage, so that the power supply circuit outputs a corresponding power supply voltage to the display panel.

In actual operation, it is possible to correct only one power supply voltage (the positive power supply voltage VDD or the negative power supply voltage VSS) which has a relatively large influence on the data voltage Vdata in view of costs, in this way, the voltage drop loss caused during transmission can be compensated to a certain extent, display effect of the product can be optimized, and also it will not take up too much resources.

Exemplarily, if the power supply voltage control circuit provided by the embodiment of the present disclosure comprises an amplification unit, the amplification unit is configured to amplify the first voltage difference from the comparison unit, and transmit an amplified first voltage difference to the power supply voltage control unit.

Exemplarily, if the power supply voltage comprises a positive power supply voltage or a negative power supply voltage, the comparison unit comprises a first comparison module.

The first comparison module comprises a first operational amplifier, a first resistor, a second resistor, a third resistor, and a fourth resistor.

A non-inverting input terminal of the first operational amplifier is connected to a positive power supply voltage or a negative power supply voltage through the fourth resistor, an inverting input terminal of the first operational amplifier is connected to the first reference voltage through the first resistor, and an output terminal of the first operational amplifier is connected to the non-inverting input terminal of the first operational amplifier through the third resistor.

The inverting input terminal of the first operational amplifier is further grounded through the second resistor.

The first operational amplifier outputs the first voltage difference through its output terminal.

Exemplarily, the power supply voltage comprises a positive power supply voltage or a negative power supply voltage, and the amplification unit comprises a first amplification module.

The first amplification module comprises a second operational amplifier, a fifth resistor, and a sixth resistor.

A non-inverting input terminal of the second operational amplifier is connected to the output terminal of the first operational amplifier, an inverting input terminal of the second operational amplifier is grounded through the sixth resistor, and an output terminal of the second operational amplifier is connected to the inverting input terminal of the second operational amplifier through the fifth resistor.

The second operational amplifier outputs the amplified first voltage difference through its output terminal.

Exemplarily, if the power supply voltage comprises a positive power supply voltage or a negative power supply voltage, the power supply voltage control unit comprises a first voltage control module.

The first voltage control module is configured to generate a first power supply voltage control signal based on the amplified first voltage difference and the first reference voltage and transmit the first power supply voltage control signal to the power supply circuit, so that the power supply circuit outputs a positive power supply voltage or a negative power supply voltage according to the first power supply voltage control signal; the first power supply voltage control signal is a pulse signal based on a single-wire protocol.

Exemplarily, the amplified first voltage difference outputted by the second operational amplifier is a digital signal.

The first voltage control module is further configured to perform digital-to-analog conversion on the amplified first voltage difference, and process the amplified first voltage difference, so as to cause an accuracy of the amplified first voltage difference to be the same as an accuracy of the first reference voltage.

An embodiment of the present disclosure further provides a power supply voltage control method applied to the power supply voltage control circuit described above.

Figure 6A:
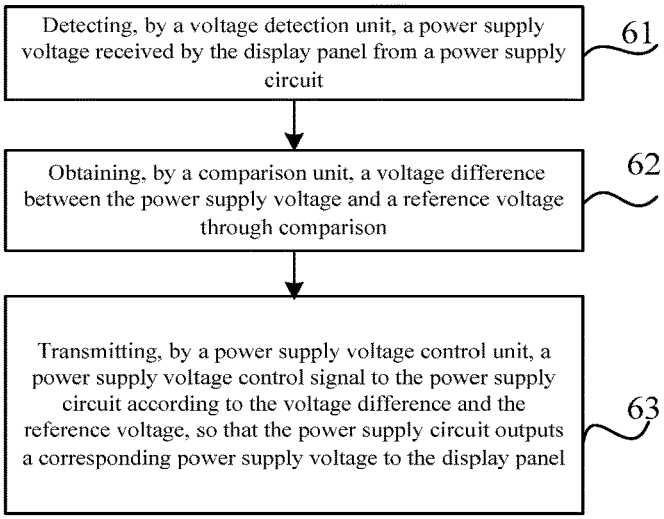
FIG. 6A is a flowchart of the power supply voltage control method for a display panel provided in an embodiment of the present disclosure.

FIG. 6A is a flowchart of the power supply voltage control method for a display panel provided in an embodiment of the present disclosure. As shown in FIG. 6A, the power supply voltage control method comprises the following steps.

A voltage detection step 61: detecting, by a voltage detection unit, a power supply voltage received by the display panel from a power supply circuit.

A comparison step 62: obtaining, by a comparison unit, a voltage difference between the power supply voltage and a reference voltage through comparison.

A power supply voltage control step 63: transmitting, by a power supply voltage control unit, a power supply voltage control signal to the power supply circuit according to the voltage difference and the reference voltage, so that the power supply circuit outputs a corresponding power supply voltage to the display panel.

The power supply voltage control method for a display panel provided by the embodiment of the present disclosure detects, by the voltage detection unit, a power supply voltage from the power supply circuit as actually received by the display panel, controls the power supply voltage outputted by the power supply circuit to the display panel according to a voltage difference between this actually detected power supply voltage and a reference voltage set in advance, to compensate for the voltage drop loss caused during transmission, so that display effect of the product can be optimized, the voltage drop loss from the output terminal of the power supply circuit to the display panel side can be reduced effectively, and consistency of the voltages inputted into the display panel side can be ensured.

Figure 6B:
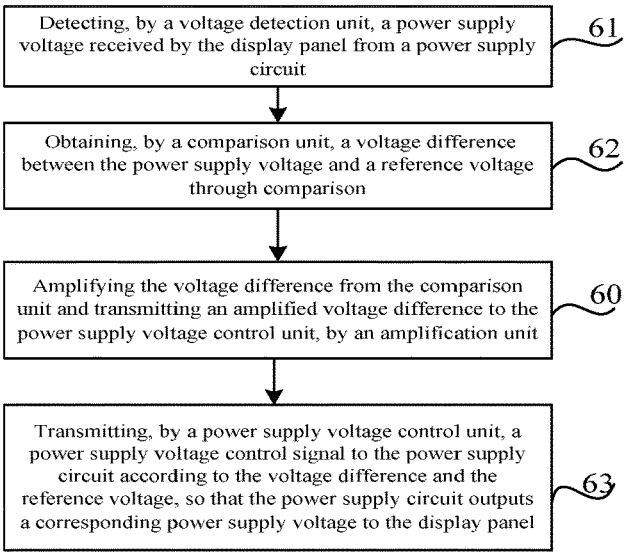
FIG. 6B is a flowchart of the power supply voltage control method for a display panel provided in another embodiment of the present disclosure.

FIG. 6B is a flowchart of the power supply voltage control method for a display panel provided in another embodiment of the present disclosure. As shown in FIG. 6B, this method differs from the method shown in FIG. 6A in that an amplification step 60 is further comprised between the comparison step 62 and the power supply voltage control step 63: amplifying the voltage difference from the comparison unit and transmitting an amplified voltage difference to the power supply voltage control unit, by an amplification unit.

Compensation for the power supply voltage can be performed more accurately by means of amplifying the voltage difference from the comparison unit 12 by the amplification unit 12.

Exemplarily, the power supply voltage control signal is a pulse signal based on a single-wire protocol, and a magnitude of the power supply voltage outputted from the power supply circuit to the display panel corresponds to a pulse number of the pulse signal.

Exemplarily, the power supply voltage includes a positive power supply voltage and a negative power supply voltage.

The reference voltage includes a first reference voltage and a second reference voltage.

The voltage detection step comprises detecting, by the voltage detection unit, a positive power supply voltage and a negative power supply voltage received by the display panel from the power supply circuit.

The comparison step comprises obtaining, by the comparison unit, a first voltage difference between the positive power supply voltage and the first reference voltage through comparison and obtaining, by the comparison unit, a second voltage difference between the negative power supply voltage and the second reference voltage through comparison.

The power supply voltage control step comprises transmitting, by the power supply voltage control unit, a first power supply voltage control signal to the power supply circuit according to the first voltage difference and the first reference voltage, so that the power supply circuit outputs a corresponding positive power supply voltage to the display panel, and further transmitting, by the power supply voltage control unit, a second power supply voltage control signal to the power supply circuit according to the second voltage difference and the second reference voltage, so that the power supply circuit outputs a corresponding negative power supply voltage to the display panel.

Exemplarily, the power supply voltage includes a positive power supply voltage or a negative power supply voltage.

The reference voltage includes a first reference voltage.

The comparison step comprises, obtaining, by the comparison unit, a first voltage difference between the power supply voltage and the first reference voltage through comparison.

The power supply voltage control step comprises transmitting, by the power supply voltage control unit, a first power supply voltage control signal to the power supply circuit according to the first voltage difference and the first reference voltage, so that the power supply circuit outputs a corresponding power supply voltage to the display panel.

An embodiment of the present disclosure further provides a driver integrated circuit, comprising the power supply voltage control circuit described above.

An embodiment of the present disclosure further provides a display device, comprising a display panel, a power supply circuit, and the driver integrated circuit described above.

The power supply voltage control circuit comprised in the driver integrated circuit is configured to detect a power supply voltage received by the display panel from the power supply circuit, transmit a power supply voltage control signal to the power supply circuit according to a voltage difference between the power supply voltage and a reference voltage, so that the power supply circuit outputs a corresponding power supply voltage to the display panel.

In an implementation, the power supply voltage control signal may be a pulse signal based on a single-wire protocol.

A voltage output of the power supply circuit controlled by instructions of the pulse signal based on the single-wire protocol is stored in the power supply circuit in the form of a look-up table, so as to facilitate conveniently and rapidly determining a voltage that the power supply circuit needs to output according to the look-up table.

Power supply voltage control of the OLED display panel will be explained below as an example. The power supply voltage control circuit for a display panel and the method thereof provided by the present disclosure are not limited to the OLED display panel in practice, and they may be also applied to a liquid crystal display panel or any type of known display panels.

In an OLED display device, a power supply circuit is provided on a motherboard, and a power supply voltage control circuit is provided on a driver IC.

First, an external signal source provides a signal to the motherboard, the power supply circuit starts to work and outputs two paths of voltages: a positive power supply voltage (i.e., a positive driving voltage for driving the OLED display panel) ELVDD and a negative power supply voltage (i.e., a negative driving voltage for driving the OLED display panel) ELVSS, the two paths of voltages come into the OLED display panel through a FPC, and at the same time, the two paths of voltages also come into a voltage detection unit comprised in the power supply voltage control circuit provided on the Driver IC, after comparison, amplification, and processing performed by the power supply voltage control unit, the Driver IC determines a voltage value to be compensated. A voltage output of the power supply circuit is controlled by an s-wire signal (the s-wire signal is the power supply voltage control signal in the form of a single pulse signal), wherein the voltage output controlled by instructions of the s-wire signal is stored in the power supply circuit in the form of a look-up table.

Figure 7:
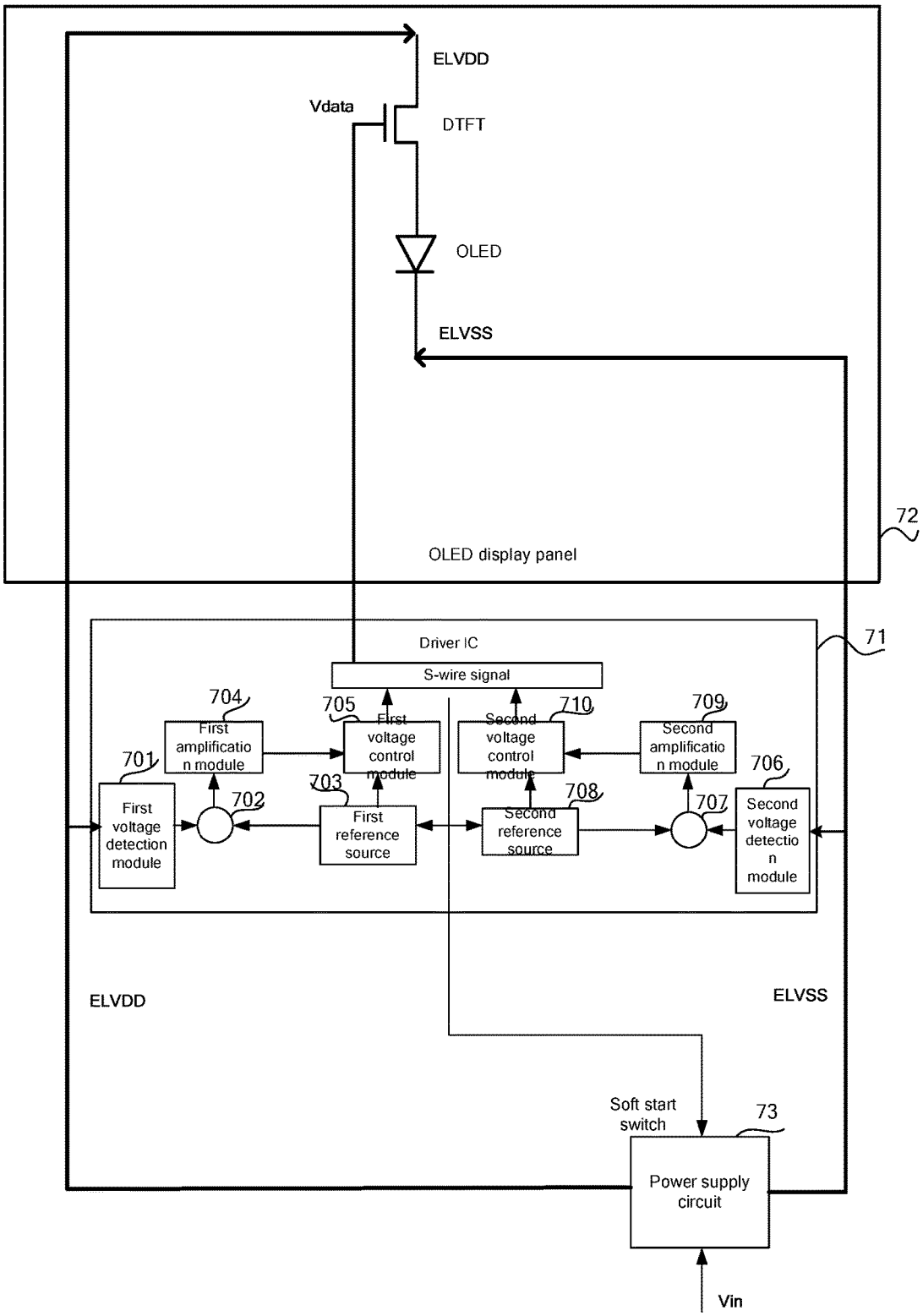
FIG. 7 is a structural schematic diagram of the power supply voltage control circuit for a display panel being applied to an OLED display panel provided in an embodiment of the present disclosure.

FIG. 7 is a structural schematic diagram of the power supply voltage control circuit for the display panel being applied to an OLED display panel provided in an embodiment of the present disclosure. As shown in FIG. 7, a first voltage detection module 701 comprised in a power supply voltage control circuit provided on a driver integrated circuit 71 detects a positive power supply voltage actually received by an OLED display panel 72, the positive power supply voltage is compared by a first comparison module 702 with a first reference voltage outputted by a first reference source 703 to obtain a first voltage difference, the first voltage difference is amplified by a first amplification module 704, an amplified first voltage difference is outputted to a first voltage control module 705, the first voltage control module 705 processes the amplified first voltage to obtain an accuracy which is the same as an accuracy of the first reference voltage outputted by the first reference source 703, then a new positive power supply voltage is obtained by adding the first reference voltage, the pulse number of the s-wire signal to which this voltage value corresponds can be determined through a look-up table, the pulse number will be fed back to the power supply circuit 73, the power supply circuit 73 is controlled to output the new positive power supply voltage.

A second voltage detection module 706 comprised in the power supply voltage control circuit provided on the driver integrated circuit 71 detects a negative power supply voltage actually received by the OLED display panel 72, the negative power supply voltage is compared by the second comparison module 707 with a second reference voltage outputted by a second reference source 708 to obtain a second voltage difference, the second voltage difference is amplified by a second amplification module 709, an amplified second voltage difference is outputted to a second voltage control module 710, the second voltage control module 710 processes the amplified second voltage to obtain an accuracy which is the same as an accuracy of the second reference voltage outputted by the second reference source 708, then a new negative power supply voltage is obtained by adding the second reference voltage, the pulse number of the s-wire signal to which this voltage value corresponds can be determined through a look-up table, the pulse number will be fed back to the power supply circuit 73, the power supply circuit 73 is controlled to output the new negative power supply voltage.

In FIG. 7, Vin is an input voltage signal of the power supply circuit 73, and the s-wire signal controls the power supply circuit to output a corresponding power supply voltage by activating a soft start switch of the power supply circuit. In the OLED display panel 72, what is labeled as DTFT is a driving transistor, and what is labeled as OLED is an organic light emitting diode.

In the known display devices, the s-wire signal is associated only with a data voltage Vdata outputted by a data line, but the present disclosure also associates the s-wire signal with the actually detected power supply voltage and the reference voltage that is set in advance. According to an actual situation of an image, within each frame, the data voltage Vdata will be judged and a set of s-wire signals will be outputted to control a magnitude of the voltage outputted by the power supply circuit. In an actual situation, there is hardly such case that the same one picture is displayed within only one frame, thus, at the first frame, it mainly is recording the reference source and testing an actual power supply voltage at the display panel side, and from the next frame, correction on the power supply voltage outputted by the power supply circuit can be performed, in this way, basically, it will not affect the display effect of the display panel.

The above described are merely exemplary implementations of the present disclosure, however, it should be noted that, those of ordinary skill in the art can make some improvements and modifications without departing from the principles of the present disclosure, these modification and improvements should be considered as falling into the protection scope of the present disclosure.

The present application claims the priority of Chinese Patent Application No. 201610006334.9 filed on Jan. 4, 2016, which is incorporated as part of the present application by reference herein in its entirety.

What is claimed is:

1. A power supply voltage control circuit for a display panel, comprising:

a voltage detection sub-circuit configured to detect a power supply voltage received by the display panel from a power supply circuit;

a comparison sub-circuit configured to obtain a voltage difference between the power supply voltage and a reference voltage through comparison; and a power supply voltage control sub-circuit configured to transmit a power supply voltage control signal to the power supply circuit according to the voltage difference and the reference voltage, and controls the power supply voltage outputted by the power supply circuit to the display panel, wherein the power supply voltage includes a positive power supply voltage and a negative power supply voltage;

the reference voltage includes a first reference voltage and a second reference voltage;

the voltage detection sub-circuit is configured to detect a positive power supply voltage and a negative power supply voltage received by the display panel from the power supply circuit;

the comparison sub-circuit is configured to obtain a first voltage difference between the positive power supply voltage and the first reference voltage through comparison and obtain a second voltage difference between the negative power supply voltage and the second reference voltage through comparison; and the power supply voltage control sub-circuit is configured to transmit a first power supply voltage control signal to the power supply circuit according to the first voltage difference and the first reference voltage, so that the power supply circuit outputs a corresponding positive power supply voltage to the display panel, and is further configured to transmit a second power supply voltage control signal to the power supply circuit according to the second voltage difference and the second reference voltage, so that the power supply circuit outputs a corresponding negative power supply voltage to the display panel.

2. The power supply voltage control circuit according to claim 1, further comprising:

an amplification sub-circuit configured to amplify the voltage difference from the comparison sub-circuit and transmit an amplified voltage difference to the power supply voltage control sub-circuit.

3. The power supply voltage control circuit according to claim 1, wherein the power supply voltage control signal is a pulse signal based on a single-wire protocol, and a magnitude of the power supply voltage outputted from the power supply circuit to the display panel corresponds to a pulse number of the pulse signal.

4. The power supply voltage control circuit according to claim 1, wherein the amplification sub-circuit is configured to amplify the first voltage difference and the second voltage difference from the comparison sub-circuit, respectively, and transmit an amplified first voltage difference and an amplified second voltage difference to the power supply voltage control sub-circuit.

5. The power supply voltage control circuit according to claim 4, wherein the comparison sub-circuit comprises a first comparison sub-circuit and a second comparison sub-circuit;

the first comparison sub-circuit comprises a first operational amplifier, a first resistor, a second resistor, a third resistor, and a fourth resistor;

a non-inverting input terminal of the first operational amplifier is connected to the positive power supply voltage through the fourth resistor, an inverting input terminal of the first operational amplifier is connected to the first reference voltage through the first resistor, and an output terminal of the first operational amplifier is connected to the non-inverting input terminal of the first operational amplifier through the third resistor;

the inverting input terminal of the first operational amplifier is further grounded through the second resistor; and the first operational amplifier outputs the first voltage difference through its output terminal;

the second comparison sub-circuit comprises a second operational amplifier, a fifth resistor, a sixth resistor, a seventh resistor, and an eighth resistor;

a non-inverting input terminal of the second operational amplifier is connected to the negative power supply voltage through the eighth resistor, an inverting input terminal of the second operational amplifier is connected to the second reference voltage through the fifth resistor, and an output terminal of the second operational amplifier is connected to the non-inverting input terminal of the second operational amplifier through the seventh resistor;

the inverting input terminal of the second operational amplifier is further grounded through the sixth resistor; and the second operational amplifier outputs the second voltage difference through its output terminal.

6. The power supply voltage control circuit according to claim 5, wherein the amplification sub-circuit comprises a first amplification sub-circuit and a second amplification sub-circuit;

the first amplification sub-circuit comprises a third operational amplifier, a ninth resistor, and a tenth resistor;

a non-inverting input terminal of the third operational amplifier is connected to the output terminal of the first operational amplifier, an inverting input terminal of the third operational amplifier is grounded through the tenth resistor, and an output terminal of the third operational amplifier is connected to the inverting input terminal of the third operational amplifier through the ninth resistor; and the third operational amplifier outputs an amplified first voltage difference through its output terminal;

the second amplification sub-circuit comprises a fourth operational amplifier, an eleventh resistor, and a twelfth resistor;

a non-inverting input terminal of the fourth operational amplifier is connected to the output terminal of the second operational amplifier, an inverting input terminal of the fourth operational amplifier is grounded through the twelfth resistor, and an output terminal of the fourth operational amplifier is connected to the inverting input terminal of the fourth operational amplifier through the eleventh resistor; and the fourth operational amplifier outputs an amplified second voltage difference through its output terminal.

7. The power supply voltage control circuit according to claim 6, wherein the power supply voltage control sub-circuit comprises a first voltage control sub-circuit and a second voltage control sub-circuit;

the first voltage control sub-circuit is configured to generate a first power supply voltage control signal based on the amplified first voltage difference and the first reference voltage and transmit the first power supply voltage control signal to the power supply circuit, so that the power supply circuit outputs a positive power supply voltage according to the first power supply voltage control signal; the first power supply voltage control signal is a pulse signal based on a single-wire protocol; and the second voltage control sub-circuit is configured to generate a second power supply voltage control signal based on the amplified second voltage difference and the second reference voltage and transmit the second power supply voltage control signal to the power supply circuit, so that the power supply circuit outputs a negative power supply voltage according to the second power supply voltage control signal; the second power supply voltage control signal is a pulse signal based on a single-wire protocol.

8. The power supply voltage control circuit according to claim 7, wherein the amplified first voltage difference outputted by the third operational amplifier is a digital signal, and the amplified second voltage difference outputted by the fourth operational amplifier is a digital signal;

the first voltage control sub-circuit is further configured to perform digital-to-analog conversion on the amplified first voltage difference, and process the amplified first voltage difference, so as to cause an accuracy of the amplified first voltage difference to be the same as an accuracy of the first reference voltage; and the second voltage control sub-circuit is further configured to perform digital-to-analog conversion on the amplified second voltage difference, and process the amplified second voltage difference, so as to cause an accuracy of the amplified second voltage difference to be the same as an accuracy of the second reference voltage.

9. The power supply voltage control circuit according to claim 1, wherein the power supply voltage includes a positive power supply voltage or a negative power supply voltage;

the reference voltage includes a first reference voltage;

the comparison sub-circuit is configured to obtain a first voltage difference between the power supply voltage and the first reference voltage through comparison;

the power supply voltage control sub-circuit is configured to transmit a first power supply voltage control signal to the power supply circuit according to the first voltage difference and the first reference voltage, so that the power supply circuit outputs a corresponding power supply voltage to the display panel.

10. The power supply voltage control circuit according to claim 9, wherein the amplification sub-circuit is configured to amplify the first voltage difference from the comparison sub-circuit, and transmit an amplified first voltage difference to the power supply voltage control sub-circuit.

11. The power supply voltage control circuit according to claim 10, wherein the comparison sub-circuit comprises a first comparison module;

the first comparison module comprises a first operational amplifier, a first resistor, a second resistor, a third resistor, and a fourth resistor;

a non-inverting input terminal of the first operational amplifier is connected to the positive power supply voltage or a negative power supply voltage through the fourth resistor, an inverting input terminal of the first operational amplifier is connected to the first reference voltage through the first resistor, and an output terminal of the first operational amplifier is connected to the non-inverting input terminal of the first operational amplifier through the third resistor;

the inverting input terminal of the first operational amplifier is further grounded through the second resistor; and the first operational amplifier outputs the first voltage difference through its output terminal.

12. The power supply voltage control circuit according to claim 11, wherein the amplification sub-circuit comprises a first amplification sub-circuit;

the first amplification sub-circuit comprises a second operational amplifier, a fifth resistor, and a sixth resistor;

a non-inverting input terminal of the second operational amplifier is connected to the output terminal of the first operational amplifier, an inverting input terminal of the second operational amplifier is grounded through the sixth resistor, and an output terminal of the second operational amplifier is connected to the inverting input terminal of the second operational amplifier through the fifth resistor; and the second operational amplifier outputs the amplified first voltage difference through its output terminal.

13. The power supply voltage control circuit according to claim 12, wherein the power supply voltage control sub-circuit comprises a first voltage control sub-circuit;

the first voltage control sub-circuit is configured to generate a first power supply voltage control signal based on the amplified first voltage difference and the first reference voltage and transmit the first power supply voltage control signal to the power supply circuit, so that the power supply circuit outputs a positive power supply voltage or a negative power supply voltage according to the first power supply voltage control signal; the first power supply voltage control signal is a pulse signal based on a single-wire protocol.

14. The power supply voltage control circuit according to claim 13, wherein the amplified first voltage difference outputted by the second operational amplifier is a digital signal; and the first voltage control sub-circuit is further configured to perform digital-to-analog conversion on the amplified first voltage difference, and process the amplified first voltage difference, so as to cause an accuracy of the amplified first voltage difference to be the same as an accuracy of the first reference voltage.

15. A power supply voltage control method applied to the power supply voltage control circuit according to claim 1, the power supply voltage control method comprising:

a voltage detection step of detecting, by a voltage detection sub-circuit, a power supply voltage received by the display panel from a power supply circuit;

a comparison step of obtaining, by a comparison sub-circuit, a voltage difference between the power supply voltage and a reference voltage through comparison; and a power supply voltage control step of transmitting, by a power supply voltage control sub-circuit, a power supply voltage control signal to the power supply circuit according to the voltage difference and the reference voltage, so that the power supply circuit outputs a corresponding power supply voltage to the display panel.

16. The power supply voltage control method according to claim 15, the following is further comprised between the comparison step and the power supply voltage control step:

an amplification step of amplifying the voltage difference from the comparison sub-circuit and transmitting an amplified voltage difference to the power supply voltage control sub-circuit, by an amplification sub-circuit.

17. The power supply voltage control method according to claim 15, wherein the power supply voltage control signal is a pulse signal based on a single-wire protocol, and a magnitude of the power supply voltage outputted from the power supply circuit to the display panel corresponds to a pulse number of the pulse signal.

18. A driver integrated circuit, comprising the power supply voltage control circuit according to claim 1.

19. A display device, comprising a display panel, a power supply circuit, and the driver integrated circuit according to claim 18, wherein the power supply voltage control circuit comprised in the driver integrated circuit is configured to detect a power supply voltage received by the display panel from a power supply circuit, transmit a power supply voltage control signal to the power supply circuit according to a voltage difference between the power supply voltage and a reference voltage, so that the power supply circuit outputs a corresponding power supply voltage to the display panel.

* * * * *